US005313020A

United States Patent [19]

Sackett

[11] Patent Number: 5,313,020

[45] Date of Patent: May 17, 1994

[54] ELECTRICAL CABLE

[75] Inventor: James A. Sackett, Houston, Tex.

[73] Assignee: Western Atlas International, Inc., Houston, Tex.

[21] Appl. No.: 890,942

[22] Filed: May 29, 1992

[51] Int. Cl.[5] ..... H01B 11/06; H01B 13/00

[52] U.S. Cl. ..... 174/113 C; 156/47; 156/51; 174/36; 174/116; 174/131 A

[58] Field of Search ..... 774/113 C, 113 R, 131 A, 774/116, 36; 156/47, 51

[56] References Cited

U.S. PATENT DOCUMENTS

| | | | |
|---|---|---|---|
| 2,325,549 | 7/1943 | Ryzowitz . | |
| 2,871,151 | 1/1959 | Lipton . | |
| 3,209,064 | 9/1965 | Cutler . | |
| 3,610,814 | 10/1971 | Peacock | 174/113 R |
| 4,486,623 | 12/1984 | Ploppa | 174/113 R |
| 4,534,618 | 8/1985 | Bruggendieck . | |
| 4,675,475 | 6/1987 | Bortner et al. | 174/113 R |
| 4,816,611 | 3/1989 | Invernizzi | 174/131 A X |
| 5,043,530 | 8/1991 | Davies | 174/36 |
| 5,120,905 | 6/1992 | Cousin et al. | 174/113 C |
| 5,159,157 | 10/1992 | Diegmann | 174/113 C |

FOREIGN PATENT DOCUMENTS

| | | | |
|---|---|---|---|
| 570380 | 2/1959 | Canada | 174/113 C |
| 2095459 | 9/1982 | United Kingdom | 174/113 R |

*Primary Examiner*—Morris H. Nimmo
*Attorney, Agent, or Firm*—Paul S. Madan

[57] ABSTRACT

A twin-axial cable comprises a central core around which two conductors are helically wrapped. Interspersing a plurality of spacers between the conductors determines the relative placement of the two conductors on the core. A dielectric barrier encases the core, conductors, and spacers.

12 Claims, 4 Drawing Sheets

ELECTRICAL CABLE

BACKGROUND OF THE INVENTION

1. Field of the Invention

This invention relates generally to electrical signal transmission, and more particularly to shielded transmission cable having a high degree of flexing endurance, compactness, and improved mechanical and electrical characteristics.

2. Description of Prior Art

Twin-axial cable is generally formed by encasing two electric conductors, separated a predetermined distance, within a dielectric layer. The distance of separation between the two conductors is selected, in part, to prevent degradation of the electric signal. Signal degradation occurs when there is a change in the electric signal. The electrical characteristics which represent two forms of degradation are the "attenuation" ratio and the "characteristic impedance of transmission" value. Both of these characteristics can be partially controlled by the distance of separation between the two conductors. It is desirable, therefore, to maintain a selected distance of separation between the conductors since the distance can affect these two characteristics, which in turn affects the signal degradation and overall performance of the cable.

A significant problem in connection with the distance of separation between the two conductors is in maintaining the separation along the entire length of the cable during manufacturing. Twin conductor cables made in accordance with the prior art require a high degree of skill to ensure a desired distance of separation between the two conductors. Although a cable design has specific requirements, meeting the requirements is often heavily dependent on the skill level of the particular manufacturer. Another problem occurs in adjusting the distance of separation between the conductors to meet specific design needs. Typically, in prior art, significant alterations to a cable design must be made to effectuate new electrical requirements. These alterations, in turn, result in significant changes in the manufacturing process. It is desirable when addressing conductor separation problems, therefore, to decrease the skill level requirements of the manufacturer and design a cable that is easily altered to meet specific electrical needs.

The dielectric layer that encases the conductors serves several purposes. First, it is used to physically hold the conductors in their proper geometric configuration. Second, it serves as a protective barrier for the conductors. In certain applications, a cable may be subject to harsh chemical and physical environments, such as extreme temperatures, high pressures, and corrosive conditions. If the conductors come in contact with this environment, signal degradation or physical damage can occur.

A common problem with the dielectric layer arises in its capacity as a protective barrier. If the layer is not sufficiently thick around the conductors, cracks that form in the dielectric layer can penetrate to the conductors, exposing them to the outside environments. However, if the layer is too thick, the cable is less flexible. Another problem which stems from encasing the conductors with the dielectric layer is the formation of interstices. If the encasing process is not properly performed, these interstices often form between the conductors and the dielectric layer. Formation of the interstices compounds the problems associated with the formation of cracks in the dielectric layer, by allowing penetration of undesirable materials into the critical regions to maintain signal integrity.

FIGS. 1 and 2 depict on type of twin-axial cable 36 of the prior art. This cable consists of two insulated conductors 30, 30', twisted together, and encased in a dielectric layer 31. In forming the cable 36, the first step involves surrounding each conductor 30, 30' with a large diameter insulation jacket 32, 32' The thickness of the jacket is selected to be one-half the desired distance of separation between the two conductors. In the next step, the insulated conductors are twisted together. When this step is complete, the conductors are properly separated because of the thickness of the insulation jacket around each conductor. A dielectric layer 31 is then formed around the twisted, insulated conductors. Next, a shield 33 is braided over the dielectric layer. Finally, an outside jacket 35 is formed around the braided shield 33.

There are several disadvantages with the twin-axial cable illustrated in FIGS. 1 and 2. The dielectric 31 tends to crack at point "a", where the thickness of the dielectric is relatively small compared to the thickness at point "b". The dielectric layer 31 in this example compounds the problem because of the thin sections closest to the insulated conductors 30, 30'. Further, if the insulated conductors 30, 30' do not remain substantially concentric with the dielectric layer 31 during manufacturing, portions of the insulated conductors in the areas where the layer thickness is small, i.e. point "a", may not be covered at all by the layer. Depending on the skill of the manufacturer, therefore, these thin sections of the dielectric layer 31 provide, at best, only a comparatively thin barrier of protection for the insulated conductors, and at worst, provide no barrier of protection at all.

A second disadvantage with the cable of FIGS. 1 and 2 also stems from the thick and thin sections of the dielectric layer 31 encasing the insulated conductors 30, 30'. Typically, the dielectric layer is encased around the insulated conductors by extrusion. The extrusion process ideally produces a cylindrical extrusion that is substantially concentric with the twisted, insulated conductors. The physical design of the cable 36, however, creates difficulties in achieving this goal because of material shrinkage of the dielectric layer 31 upon cooling of the thick and thin sections. Material shrinkage depends on the material. Since the thickness of the dielectric layer material is not the same around the cross-section, the shrinkage of sections of varying thickness is not uniform. Thicker sections such as that of point "b" will tend to shrink more than the thinner section of point "a". The disparity in shrinkage provides a cross section of the extrusion that is not substantially cylindrical. The non-cylindrical shape of the extrusion results in additional problems and expense in making and installing the braided shield 33.

The design of the cable of FIGS. 1 and 2 may also result in the formation of interstices. The materials selected for the dielectric layer 31 and the insulation jackets 32, 32' generally do not have the same chemical base. When the dielectric layer is extruded around the insulated conductors, the two materials may not bond due to the difference in the two materials. At the points where a bond does not form between the two materials, interstices form instead.

FIGS. 3 and 4 depict a second method of making a twin-axial cable. A cable 26 consists of two uninsulated conductors 20, 20', separated by a predetermined distance, and encased in a dielectric layer 21. In forming the cable 26, the first step involves extruding a dielectric layer 21 around the two uninsulated conductors 20, 20'. As the dielectric is extruded around the conductors, the conductors are held substantially parallel to each other at the required distance. Again, a braided shield 23 is placed around the extrusion. Finally, a protective jacket 25 is extruded over the braid.

This type of twin-axial configuration has an advantage over the twin-axial cable of FIGS. 1 and 2 in that there is no opportunity for interstices to form around the conductors since there are no conductor insulation jackets to which the dielectric layer material must bond. However, the advantages of this method over the previously described method are outweighed by the loss of flexibility of the cable. As shown in FIGS. 3 and 4, the conductors are fixed in the same geometric plane for the entire length of the cable. When the cable is flexed, or bent, orthogonally to the plane containing the conductors, each conductor has an equal amount of tension and compression placed upon it. However, if the cable is made to flex so that it is bent in the plane of the conductors, so that the direction of the bend is coplanar with the two conductors, one of the conductors will be placed in a much higher state of tension than the other conductor. This results in a cable which is stiff and more susceptible to fatigues stress.

The present invention provides a cable which has improved mechanical and electrical characteristics over prior art.

SUMMARY OF THE INVENTION

The present invention provides a configuration for twin-axial cable and a method for making the cable. The cable comprises a central core with two conductors helically wrapped around it. The relative placement of the two conductors on the core is accomplished by interspersing a plurality of spacers between the conductors on the surface of the core. A dielectric barrier encases the core, conductors, and spacers. Because each type of twin-axial transmission cable has its own electrical and mechanical requirements, the cable has a design that can be easily altered before manufacturing to meet these varying needs. By selecting among the many dielectric materials available with which to manufacture these elements, as well as selecting the physical dimensions of the elements, the electrical and mechanical characteristics can be "tuned" to meet specific requirements.

DESCRIPTION OF THE PREFERRED EMBODIMENTS

Figure 1:
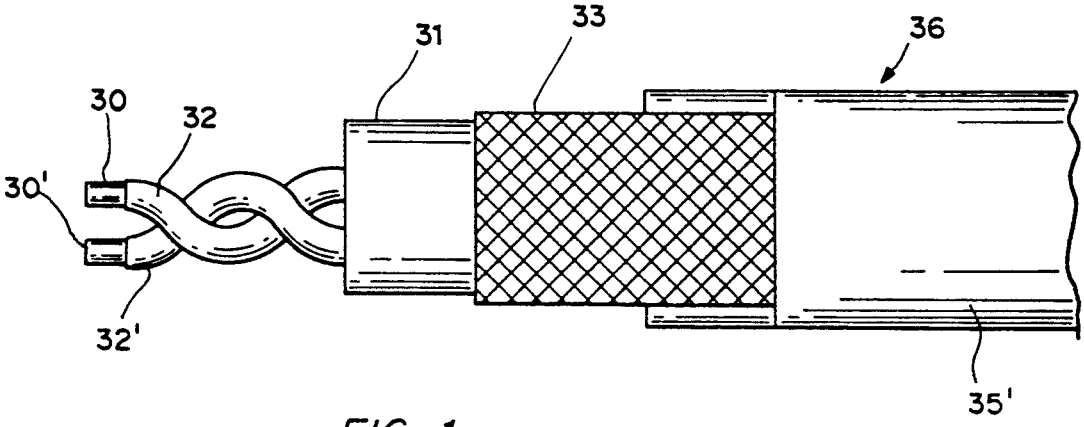
FIG. 1 PRIOR ART
FIG. 1 illustrates a detailed side view of a portion of a twin-axial electrical transmission cable formed by encasing a pair of twisted, insulated conductors in a dielectric layer, shown cut back to reveal relevant details.
Figure 2:
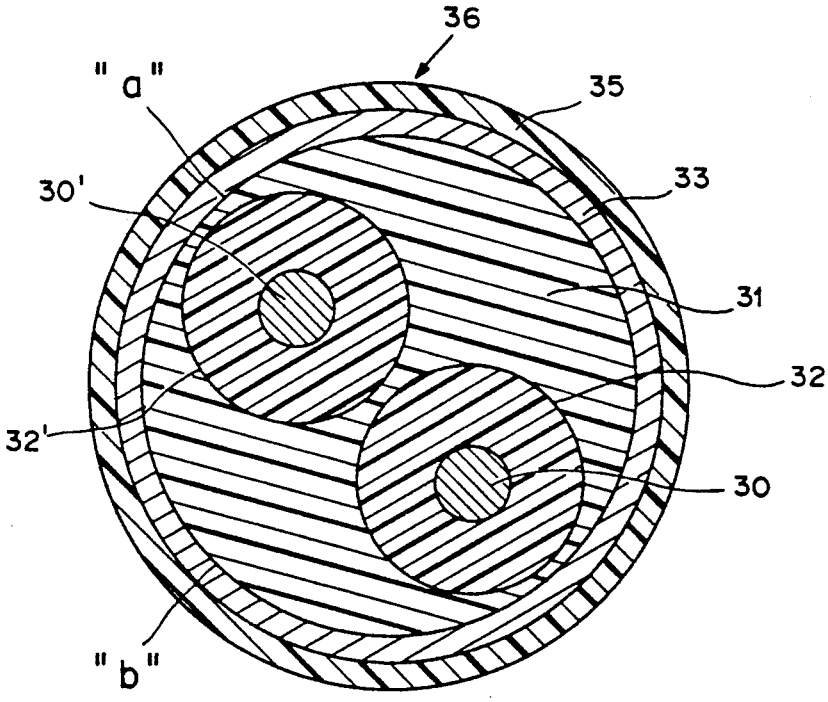
FIG. 2 PRIOR ART
FIG. 2 illustrates a cross-section of a portion of the cable of FIG. 1 depicting the physical relationship of the elements comprising the cable.
Figure 3:
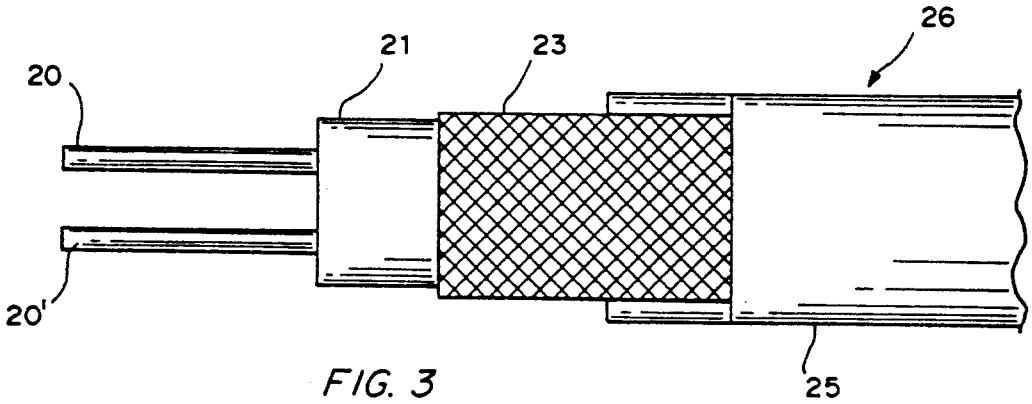
FIG. 3 PRIOR ART
FIG. 3 illustrates a detailed side view of a portion of a twin-axial electrical transmission cable formed by encasing a pair of uninsulated conductors in a dielectric layer, shown cut back to reveal relevant details.
Figure 4:
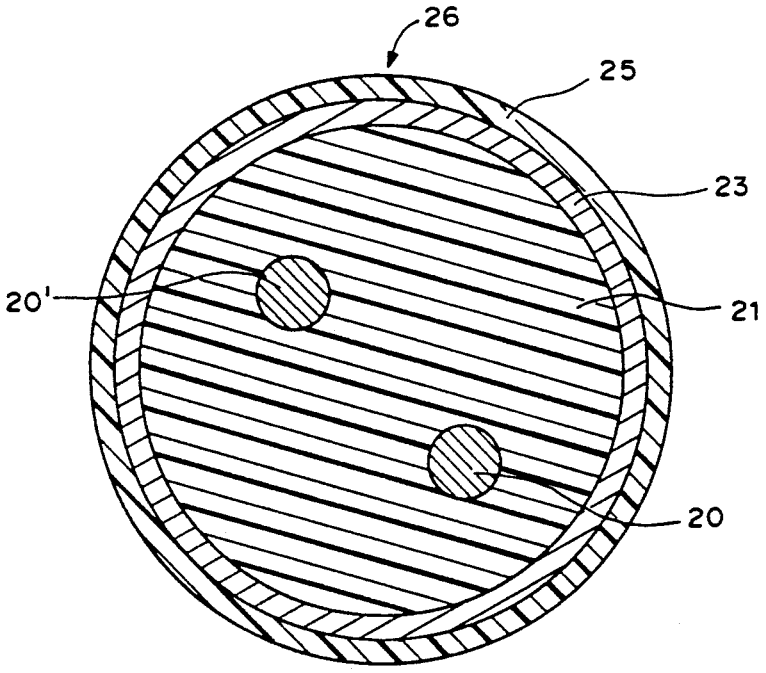
FIG. 4 PRIOR ART
FIG. 4 illustrates a cross-sectional of a portion of the cable of FIG. 3 depicting the physical relationship of the elements comprising the cable.
Figure 5:
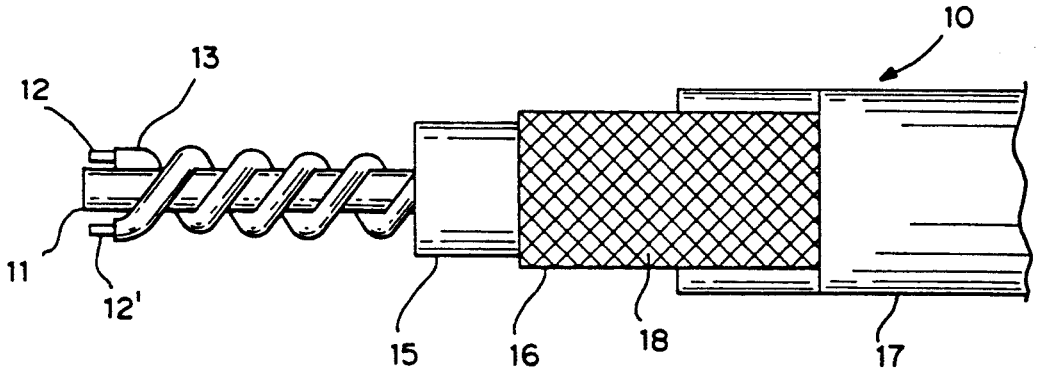
FIG. 5 illustrates a detailed side view of a portion of a shielded cable of the present invention formed by wrapping insulated electrical conductors around a central core and encasing the core and conductors in a dielectric layer.

FIG. 5 shows a preferred embodiment of a cable 10. It contains a central core 11 and a plurality of insulated conductors 12, 12'. The conductors 12, 12' are helically wound around the core 11. As the conductors 12, 12' wind around the core 11, they remain substantially diametrically opposed along the length of the core. The core 11 and the conductors 12, 12' are encased in a dielectric layer 15. The dielectric layer is surrounded by shield 16. Typically, the shield 16 is made of braided, metallic wire. An outer dielectric jacket 17 forms a continuous sheath around the shield 16. The elements 11, 12, 12', 15, 16, and 17 thus comprise a shielded, electric cable.

Figure 6:
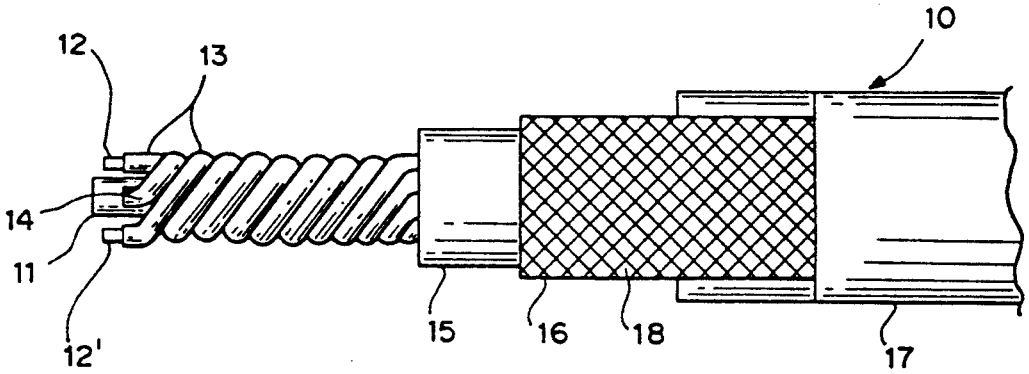
FIG. 6 illustrates a detailed side view of a portion of a shielded cable of the present invention formed by wrapping insulated electrical conductors and a plurality of spacers around a central core in encasing the core, conductors, and spacers in a dielectric layer.
Figure 7:
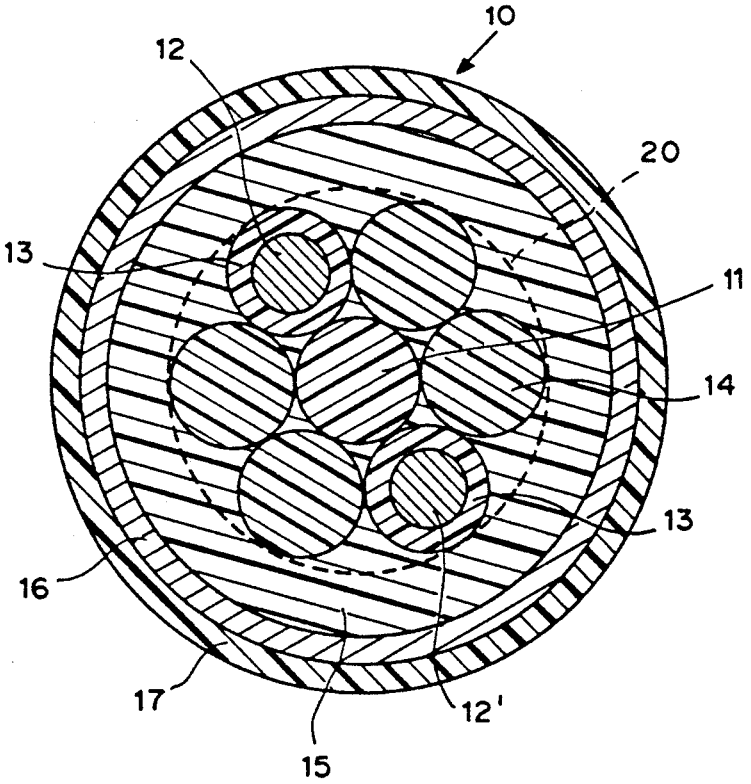
FIG. 7 illustrates e cross-sectional view of a cable of the present invention formed by wrapping electrical conductors and a plurality of spacers around a central core and encasing the core and conductors in a dielectric layer.

FIGS. 6 and 7 depict another preferred embodiment of the cable 10. The cable 10 contains a plurality of spacers 14 which are helically wound with the insulated conductors 12, 12' along the core 11. The axial length required for one complete spiral of the conductors 12, 12' and spacers 14, referred to as lay-length, will vary depending on the flexibility and other requirements of the cable. Typically, the lay-length will range from 8 to 16 times the pitch of the layer, the pitch diameter being defined as the center to center distance of two diametrically opposed components of the cable. The spacers 14 are partially utilized, therefore, to position the insulated conductors 12, 12' on the periphery of the core 11 so that the insulated conductors are substantially diametrically opposed. This combination creates an interior element 20 comprising the core 11, the insulated conductors 12, 12', and the spacers 14. This interior element 20 has a uniform diameter along the length of the cable and is uniformly cylindrical.

The core 11 serves several purposes. First, it separates the insulated conductors 12, 12' the necessary distance to achieve the desired electrical requirements. Second, it renders the separation of the insulated conductors less skill dependent than the cables of FIGS. 1–4. In this invention, the thickness of the insulation jacket 13 of each conductor need not be changed to meet the electrical requirements of a specific cable since the core 11 is the element that determines distance of separation between the conductors. Thus, the same insulated conductor wire can be used in cables with varying electrical requirements. Also, the procedure of extruding jackets that results in jackets of varying thickness around conductors is eliminated. This, in turn, reduces the skill level required in assembling the cable 10. When the dimensions of the core are determined, however, the thickness of the insulation jacket 13 around each conductor 12, 12' should be added to the diameter of the core when determining the distance of separation between the conductors.

As mentioned, one purpose of the spacers 14 is to ensure proper separation of the insulated conductors 12, 12' as they are wrapped around the core 11. In the preferred embodiment, an even number of spacers is used to ensure that the insulated conductors 12, 12' are substantially 180 degrees apart in their physical relation on the periphery of e cylindrical core 11. The particular number of spacers will be dependent on the individual configuration requirements determined from the electrical properties desired. In the example, an even number of spacers is selected to maintain a uniform geometric configuration around the core 11. An even number of spacers 14 is not required, however, as long as the proper separation of the conductors 12, 12' is maintained. Furthermore, although the spacers 14 and the core 11 are shown to be cylindrical, this shape is not a necessity for either element. The dimensions of the spacers are also variable and depend on the geometric configuration of the cable 10. In the preferred embodiment of FIGS. 6 and 7, the diameter of the spacers is selected to be equivalent to the outer diameter of the insulated conductors 12, 12'. This ensures that the overall diameter of the interior element 20 is substantially constant. The diameter of the spacers, however, need not to be the same as the diameter of the insulated conductors. The dimensions of each individual spacer can be of varying diameter as long as the proper separation of the conductors 12, 12 is maintained.

Once the conductors 12, 12' and spacers 14 have been positioned on the core 11, a dielectric layer 15 is used to encase the core 11, conductors 12, 12', and spacers 14. The dielectric layer 15 serves several purposes in the preferred embodiment. First, it holds the conductors 12, 12' and the spacers 14 in place on the periphery of the core 11. Second, the layer acts as a continuous, thick walled barrier between the outside of the cable 10 and the critical area near and between the conductors 12, 12'. The utilization of the core 11 and the positioning to the conductors 12, 12' and the spacers 14 along the core 11 provides an interior element 20 whose cross-sectional diameter is substantially uniform. When the dielectric layer 15 is encased around this interior element, the thickness of the dielectric layer around the entire interior element is uniform. Thus, the conductors 12, 12' are subject to the same protection as the spacers, and no section has a significantly thicker dielectric layer than any other section.

Using the core 11 and spacers 14 also decreases the likelihood of a disparity in material shrinkage of the dielectric layer 15. Since shrinkage depends on material thickness, it is desirable to maintain a uniform material thickness around the central element. The physical presence of the spacers 14 in the preferred embodiment decreases the large disparity in material thickness by physically occupying the space around the core 11. In other words, the presence of the spacers 14, along with the conductors 12, allows less disparity between the thickest and thinnest sections of the dielectric layer 15, resulting in more uniform shrinkage of the dielectric layer. A more uniform shrinkage will then result in a shape that is more uniformly cylindrical.

The cable of the present invention can be easily altered before manufacturing to yield desired mechanical and electrical characteristics. These alterations, in effect, "tune" the cable 10 to meet desired characteristics. The design can be "tuned" electrically by altering the dimensions of the core 11, or by altering the material of the core 11, the spacers 14, and the dielectric layer 15. By regulating the diameter of the core, for example, a cable 10 can be designed to yield a desired characteristic impedance of transmission. Proper choice of materials for the core 11, the spacers 14, and the dielectric layer 15 allows the E-field to be shaped as desired based on the dielectric constants of the material. For example, the internal components could be a high-density solid polyethylene to reduce the characteristic impedance of transmission, or a foamed polyethylene for increased characteristic impedance of transmission. When selecting the materials necessary to produce the desired characteristics of the cable 10, it is advantageous to select material with a common chemical base, such as polyethylene. This insures adequate bonding between component parts and decreases the formation of interstices. As illustrated by the above examples, a material can have the same common chemical base, i.e. polyethylene, while the different members within the chemical family can display a wide range of electrical and mechanical properties.

The cable design may also be "tuned" mechanically by choice of materials for the core 11 and spacers 14, while maintaining a desired package size. For example, the core 11 could be a high density solid polyethylene for maximum crush resistance, or a foamed polyethylene for lower weight. Thus by simply varying the type of material used to form the core 11, different mechanical properties for the cable 10 can be achieved without varying the overall diameter of the cable 10.

In accordance with another embodiment of the invention, a self-healing fluidic fill may be utilized to occupy the interstices between the core 11, the insulated conductors 12, 12', and the spacers 14. This process is advantageous in that the encasing process of the dielectric layer around the interior element is less dependent on the still of the processor. If voids should form during the manufacturing process or should cracking and splitting occur during the life of the cable 10, this fluidic fill minimizes signal loss by essentially preventing any alternate conductive path for the signal from forming. While not absolutely necessary, the fill may be especially advantageous when the component materials differ and the likelihood of interstices forming is high. An example of such a fluidic fill is heavy silicon grease characterized by the proper electrical properties.

In still another embodiment of the invention, an extrusion of an electrically conductive polymer 18, may be utilized to bond the shield 16 to the dielectric layer 15 and fill the gaps in the braided shield 16. An electrically conductive material makes the shielding characteristics of the braid less frequency dependent.

Various changes in the details of the invention as described herein may be apparent to those skilled in the art. It is intended that such changes be included within the scope of the claims appended hereto.

What is claimed is:

1. A cable, comprising (a) an interior element having (i) a longitudinal cylindrical central core;

(ii) two insulated conductors helically wrapped around the core so that the conductors are substantially diametrically opposed from each other along the length of the core;

(iii) a plurality of cylindrical spacers helically wrapped around the core between the conductors to ensure that the conductors are remain substantially diametrically opposed from each other along the length of the core;

(b) a dielectric material encasing the interior element;

(c) a shield surrounding the dielectric material; and (d) an outer dielectric sheath surrounding the shield.

2. The cable of claim 1 wherein the diameter of the spacers is equivalent to the outer diameter of the insulation jacket surrounding each conductor.

3. The cable of claim 1 wherein the insulation surrounding the conductors, the dielectric material encasing the interior elements, the core, and the spacers are made of materials of the same chemical base.

4. The cable of claim 1 wherein a self-healing fluidic substance occupies interstices between the spacers, the core, and the insulated conductors.

5. The cable of claim 1 wherein the shield is a braided metallic wire.

6. The cable of claim 5 wherein en electrically conductive polymer bonds the shield to the dielectric material.

7. A method of forming a cable, comprising the steps of:

(a) helically wrapping two insulated conductors and a plurality of spacers around a longitudinal, cylindrical central core so that the spacers are located between the conductors in a manner that ensures the conductors are substantially diametrically opposed from each other along the length of the core;

(b) encasing the conductors, the plurality of spacers, and the central core within a dielectric material;

(c) surrounding the dielectric material with a shield; and (d) encasing the shield within an outer dielectric sheath.

8. The method of claim 7 wherein the shield is formed by braiding metallic wire.

9. The method of claim 8 wherein the shield is bonded to the dielectric material by an electrically conductive polymer.

10. A method of forming a twin-axial cable, comprising the steps of:

(a) helically wrapping two insulated conductors and a plurality of spacers around a longitudinal, cylindrical central core so that the spacers are located between the conductors in a way that ensures the conductors are substantially diametrically opposed from each other along the length of the core;

(b) injecting a self-healing fluidic substance in the interstices between the spacers, the insulated conductors, and the core;

(c) encasing the conductors, the plurality of spacers, and the central core within a dielectric material.

(d) surrounding the dielectric material with a shield; and (e) encasing the shield within an outer dielectric sheath.

11. The method of claim 10 wherein the shield is formed by braiding metallic wire.

12. The method of claim 10 wherein the shield is bonded to the dielectric material by an electrically conductive polymer.

* * * * *